US008282357B2

(12) United States Patent
Beckford

(10) Patent No.: US 8,282,357 B2
(45) Date of Patent: Oct. 9, 2012

(54) TURBINE BLADE

(75) Inventor: Peter R. Beckford, Derby (GB)

(73) Assignee: Rolls-Royce PLC, London (GB)

( * ) Notice: Subject to any disclaimer, the term of this patent is extended or adjusted under 35 U.S.C. 154(b) by 959 days.

(21) Appl. No.: 12/289,746

(22) Filed: Nov. 3, 2008

(65) Prior Publication Data

US 2009/0136353 A1 May 28, 2009

(30) Foreign Application Priority Data

Nov. 28, 2007 (GB) ..... 0723251.5

(51) Int. Cl.

| | |
|---|---|
| ***B63H 1/26*** | (2006.01) |
| ***B63H 7/02*** | (2006.01) |
| ***B63H 1/20*** | (2006.01) |
| ***B63H 5/00*** | (2006.01) |
| ***B63H 13/00*** | (2006.01) |
| ***B63H 15/00*** | (2006.01) |
| ***B64C 11/16*** | (2006.01) |
| ***B64C 27/46*** | (2006.01) |
| ***B64C 27/48*** | (2006.01) |
| ***B64C 11/04*** | (2006.01) |
| ***F03B 3/12*** | (2006.01) |
| ***F03D 11/00*** | (2006.01) |
| ***F04D 29/34*** | (2006.01) |
| ***F04D 29/38*** | (2006.01) |

(52) U.S. Cl. ..... 416/229 A; 416/204 R; 416/223 R

(58) Field of Classification Search ..... 416/229 A, 416/204 R, 223 R

See application file for complete search history.

(56) References Cited

U.S. PATENT DOCUMENTS

| | | | |
|---|---|---|---|
| 2,618,462 | A | 11/1952 | Kane |
| 4,738,594 | A | 4/1988 | Sato et al. |
| 6,413,050 | B1 | 7/2002 | Shimovetz |
| 6,471,485 | B1 | 10/2002 | Rossmann et al. |

FOREIGN PATENT DOCUMENTS

| | | | |
|---|---|---|---|
| DE | 1 245 218 | | 7/1967 |
| DE | 196 04 638 | A1 | 8/1997 |
| EP | 1 764 476 | A2 | 3/2007 |
| WO | WO9634181 | * | 10/1996 |
| WO | WO 00/53895 | | 9/2000 |
| WO | WO 2005/040559 | A1 | 5/2005 |

* cited by examiner

*Primary Examiner* — Fernando L Toledo
*Assistant Examiner* — Valerie N Brown
(74) *Attorney, Agent, or Firm* — Oliff & Berridge, PLC

(57) ABSTRACT

A blade arrangement (22) comprises an aerofoil (26) and a mounting support (28) to mount the blade arrangement to a disc. The aerofoil (26) is supported on the mounting support (28). The aerofoil (26) comprises a plurality of elongate aerofoil portions (34) arranged adjacent one another to provide the aerofoil.

14 Claims, 3 Drawing Sheets

TURBINE BLADE

This invention relates to blade arrangements. More particularly, but not exclusively, the invention relates to fan blades such as for use in a gas turbine engine.

The fan blades of a gas turbine engine are susceptible to damage as a result of impact from objects entering the engine. Known fan blades must retain sufficient integrity following an impact event to satisfy the requirements of the Aviation Authorities. These requirements dictate that the blade must be sufficiently stiff and strong to resist failure during an impact. This requirement means that the fan blades are many times stiffer and stronger than is needed in order to perform its aerodynamic duty. As a result, there is more weight on the blade than is necessary for all the aerodynamic function of the fan.

According to one aspect of this invention, there is provided a blade arrangement comprising an aerofoil and a mounting support upon which the aerofoil is mounted, the aerofoil comprising a plurality of elongate aerofoil portions arranged adjacent one another to provide the aerofoil.

The blade arrangement may be a fan blade arrangement.

Each aerofoil portion may be elongate, and may extend longitudinally from the mounting support, or from a region adjacent the mounting support.

In one embodiment, the aerofoil portions are separately movable relative to each other.

Each aerofoil portion may include opposite elongate edges, and each aerofoil portion may abut, or be attached to, the or each, adjacent aerofoil portion along at least one of said elongate edges.

The attachment of each aerofoil portion to the, or each, adjacent aerofoil portion may be such as to allow each aerofoil portion to become detached from the, or each, adjacent aerofoil portion on an impact by an object.

Each elongate aerofoil portion may extend radially along the aerofoil. Each aerofoil portion may extend from the mounting support, or from a region adjacent the mounting support, to a tip region of the aerofoil.

In one embodiment, each aerofoil portion may be attached to the, or each, adjacent aerofoil portion along the length of the, or each, edge. In another embodiment, each aerofoil portion may be attached to the, or each, adjacent aerofoil portion at spaced positions along the, or each, edge. In a further embodiment, each aerofoil portion may be attached to the, or each, aerofoil portion at, or adjacent, the mounting support. Each aerofoil portion may be attached to the, or each, adjacent aerofoil portion at a tip region of the aerofoil.

The edges of the aerofoil portions may extend widthwise across the aerofoil at an oblique angle to the front and rear faces of the aerofoil. The oblique angle may be between 30° and 60°.

An embodiment of the invention will now be described by way of example only, with reference to the accompanying drawings, in which.

Figure 1:
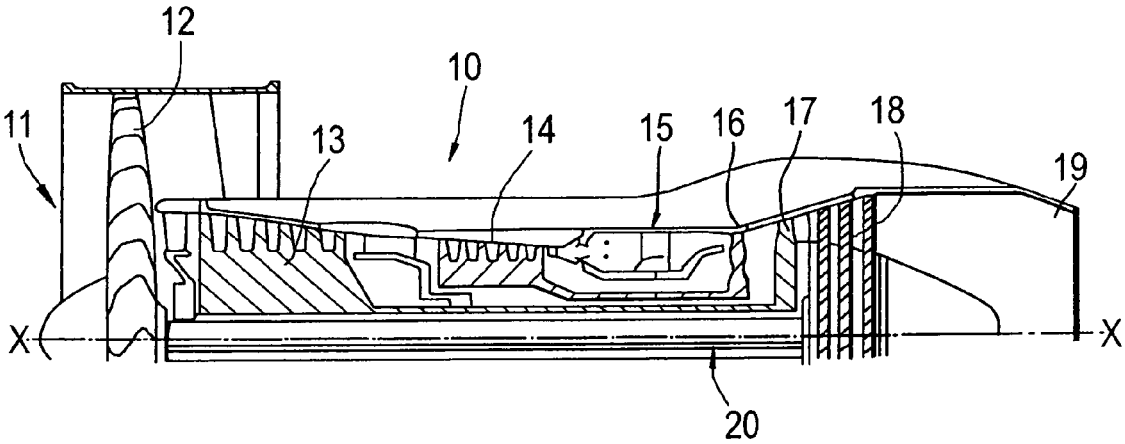
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts 20.

Figure 2:
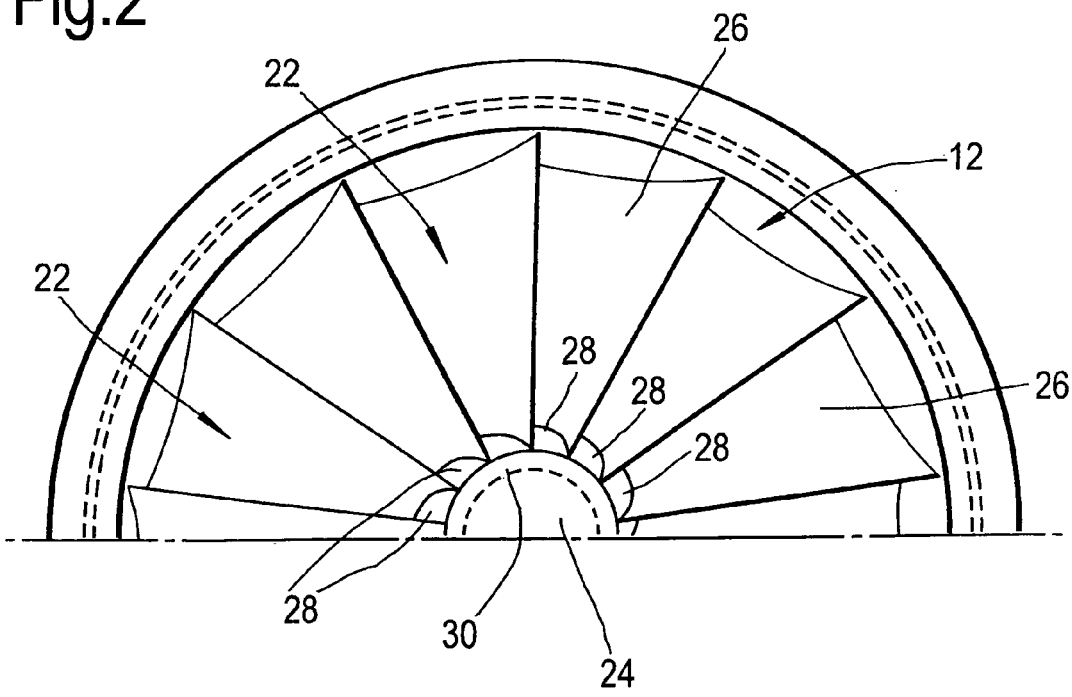
FIG. 2 is a front view of the upper half of the gas turbine engine shown in FIG. 1.

Referring to FIG. 2, there is shown the fan 12 which comprises a plurality of blade arrangements in the form of fan blade arrangements 22 extending radially from a disc 24. Each of the fan blade arrangements 22 comprises an aerofoil member 26 mounted on a platform 28 to secure the fan blade arrangements 22 to the disc 24. Generally, this blade would be attached directly to the disc and the platform 28 would be provided by another member, also attached to the disc.

Figure 3:
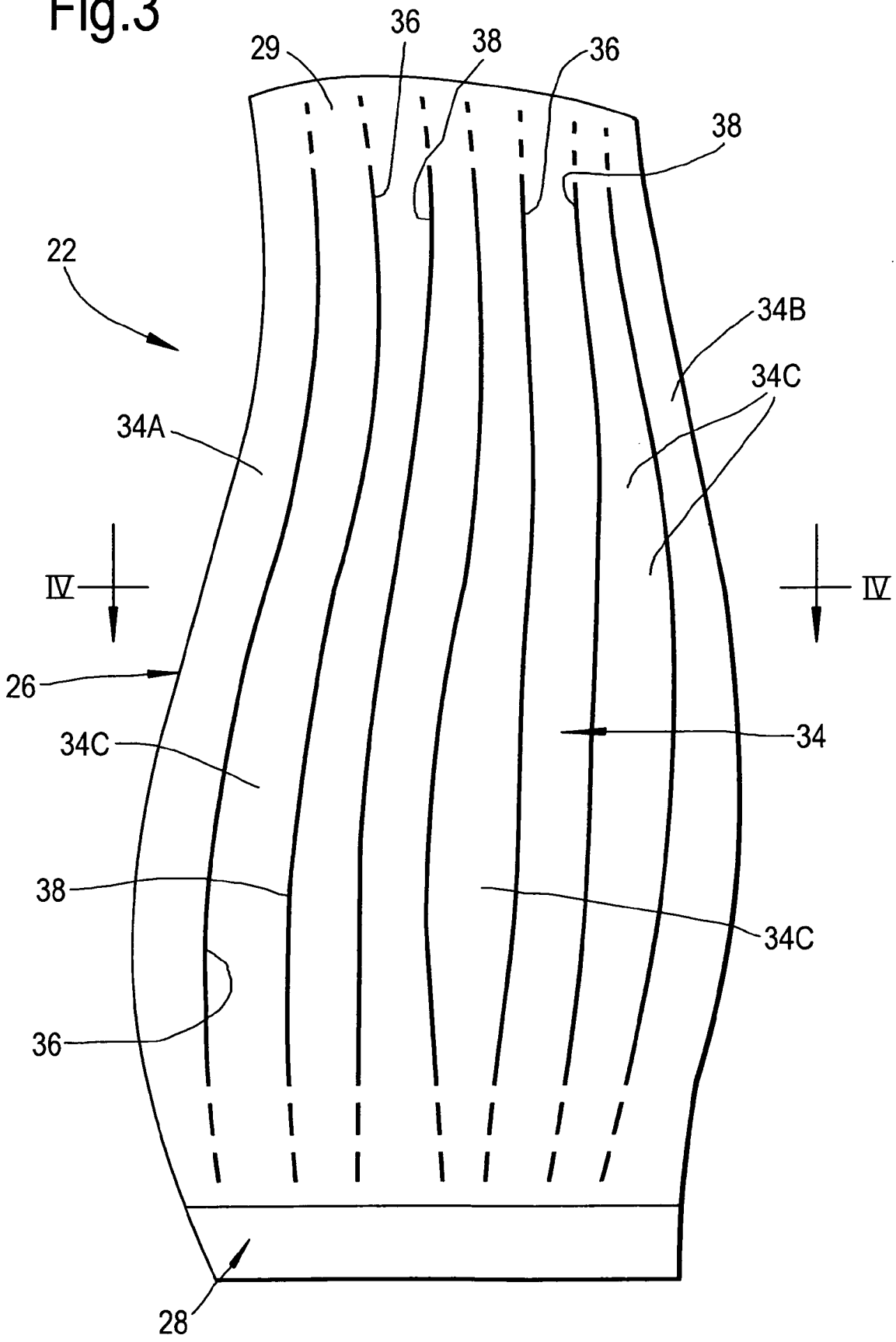
FIG. 3 is a side view of a blade arrangement.

One of the fan blades 22 is shown in FIG. 3 and comprises an aerofoil 26 extending radially outwardly from a mounting support in the form of a platform 28, to a tip 29. The platform 28 support is engaged in suitable recesses 30 on the disc 24, as would be understood by those skilled in the art.

The aerofoil 26 comprises a plurality of radially outwardly extending elongate aerofoil portions 34, arranged in succession adjacent one another and which together provide the aerofoil 26. The aerofoil portions 34 comprise a leading edge aerofoil portion 34A and a trailing edge aerofoil portion 34B. The leading and trailing edge aerofoil portions 34A, 34B are attached to, or abut, the adjacent aerofoil portions 34 only along one of their edges. This is shown more fully in FIG. 4 which is a cross-section of the aerofoil 26 showing the plurality of aerofoil portions 34. The aerofoil portions 34 arranged between the leading and trailing edge aerofoil portions 34A, 34B are designated 34C.

The aerofoil portions 34C are each provided with opposite edges 36, 38. The exception to this is the leading and trailing edge aerofoil portions 34A, 34B which only have one abutting edge 36 or 38 as shown in FIG. 4.

The aerofoil portions 34A, B and C are, in one embodiment, attached to the, or each, adjacent aerofoil portion 34 at their edges 36, 38. The attachment of the aerofoil portions 34A, B and C to one another can be by bonding or welding or brazing along the length of each of the edges 36, 38. Alternatively, the attachment may be at discrete points or regions spaced along the edges 36, 38 from the support 28 to the tip 29.

Alternatively, the aerofoil portions 34A, B and C may be attached to one another only at a region adjacent the support 28 and, if desired, at a region adjacent the tip 29.

Figure 4:
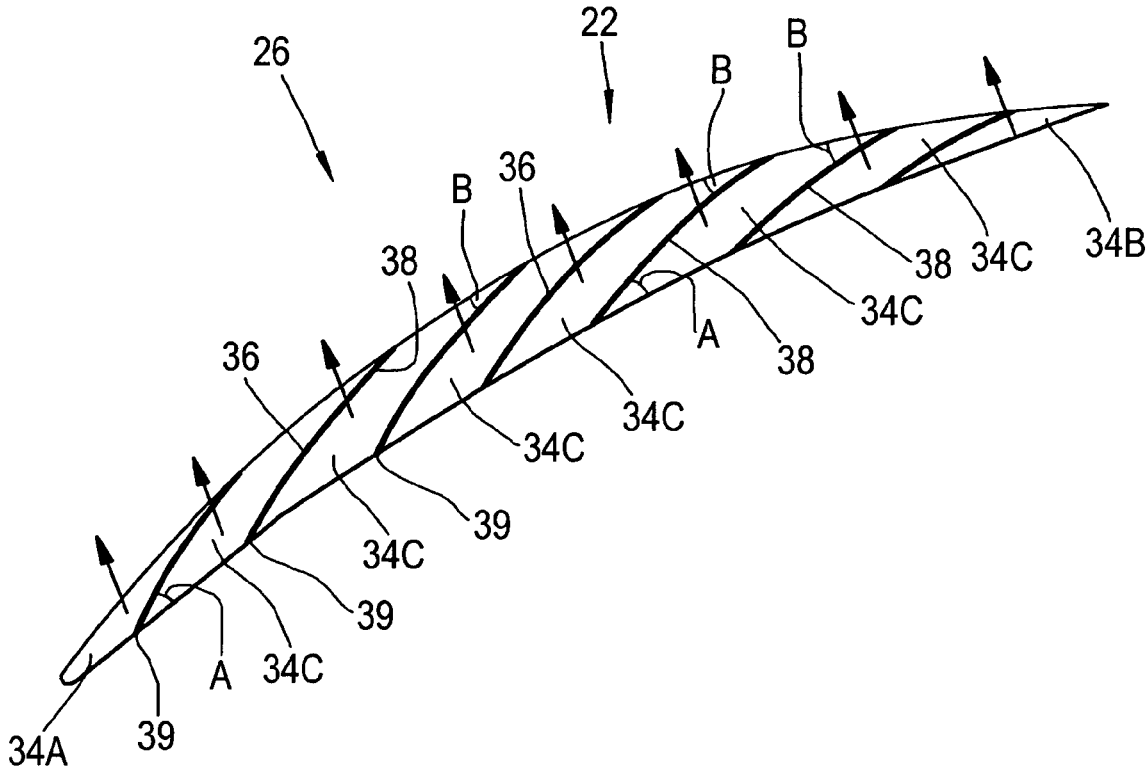
FIG. 4 is a view along the lines IV-IV in FIG. 3.

As can be seen from FIG. 4, the edges 36, 38 of the aerofoil portions 34 extend diagonally widthwise across the aerofoil 26. This orientation of the edges 36, 38 is such that during rotation of the fan 12, the centrifugal forces on the aerofoil portions 34 push the aerofoil portions 34 into engagement with one another to allow the aerofoil 26 to perform its function.

If one of the blades 22 is struck by an object, then the aerofoil portions 34 which are struck will be displaced from the other aerofoil portions. As a result, any shockwave created by the impact will not be transmitted to the remaining aerofoil portions thereby limiting damage to the blade. In addition, by arranging the edges 36, 38 at acute angles A and B to the front and rear faces of the aerofoil 26, each aerofoil portion presents a cutting edge 39 in the event that the originally preceding aerofoil portion is moved away. This can be advantageous in the event that the object is split into several pieces on impact. These pieces can be further divided by striking further cutting edges 39. There is thus described a simple and effective construction of a fan blade which allows the force of impact of an object to be dissipated into a single aerofoil portion thereby reducing the damage caused to the aerofoil 26 of the fan blade 22.

Various modifications can be made without departing from the scope of the invention. For example, the orientation of the edges 36, 38 could be different to that shown in FIG. 4.

I claim:

1. A blade arrangement comprising:

an aerofoil; and a mounting support to mount the blade arrangement to a disc, the aerofoil being supported on the mounting support, wherein the aerofoil comprises a plurality of elongate aerofoil portions arranged adjacent one another, wherein the elongate aerofoil portions are separate and each has outer surfaces, and the elongate portions cooperate together so that the outer surfaces define suction and pressure surfaces of the aerofoil.

2. A blade arrangement according to claim 1 wherein each aerofoil portion is elongate and extends along the aerofoil portion from the mounting support, or from a region adjacent the mounting support.

3. A blade arrangement according to claim 1 wherein each aerofoil portion includes opposite elongate edges, and each aerofoil portion abuts, or is attached to, the, or each, adjacent aerofoil portion along at least one of said elongate edges.

4. A blade arrangement according to claim 3 wherein where each aerofoil portion is attached to the, or each, adjacent aerofoil portion, the attachment allows each aerofoil portion to become detached from the, or each, aerofoil portion on impact by an object thereon.

5. A blade arrangement according to claim 3, wherein each aerofoil portion is attached to the, or each, adjacent aerofoil portion along the length of the, or each, edge.

6. A blade arrangement according to claim 3, wherein each aerofoil portion is attached to the, or each, adjacent aerofoil portion at spaced positions along the, or each, edge.

7. A blade arrangement according to claim 3 wherein the, or each, edge of the aerofoil portions extend width wise across the aerofoil at an oblique angle to front and rear faces of the aerofoil.

8. A blade arrangement according to claim 1 wherein each elongate aerofoil portion extends radially of the aerofoil from the mounting support, or from a region adjacent the mounting support.

9. A blade arrangement according to claim 1 wherein each aerofoil portion is attached to the, or each, adjacent aerofoil portion at a tip region of the aerofoil.

10. A blade arrangement according to claim 1 in the form of a fan blade arrangement.

11. A blade arrangement according to claim 1 wherein the mounting support comprises a platform from which the aerofoil extends generally radially.

12. A fan for a gas turbine engine comprising a rotatable mounting disc and a plurality of blade arrangements as claimed in claim 1 mounted on the mounting disc.

13. A gas turbine engine incorporating a fan as claimed in claim 12.

14. A blade arrangement comprising an aerofoil and a mounting support to mount the blade arrangement to a disc, the aerofoil being supported on the mounting support, wherein the aerofoil comprises a plurality of elongate aerofoil portions arranged adjacent one another to provide the aerofoil and the aerofoil portions are separately movable relative to each other.

* * * * *